US007385343B2

(12) United States Patent
Hirasawa et al.

(10) Patent No.: US 7,385,343 B2
(45) Date of Patent: Jun. 10, 2008

(54) DISPLAY DEVICE

(75) Inventors: Shigemi Hirasawa, Chiba (JP); Yoshiyuki Kaneko, Hachioji (JP); Susumu Sasaki, Chiba (JP); Yuuichi Kijima, Chosei (JP); Hiroshi Kawasaki, Ooamishirasato (JP)

(73) Assignees: Hitachi Displays, Ltd., Mobara-Shi (JP); Hitachi Device Engineering Co., Ltd., Mobara-Shi (JP)

( * ) Notice: Subject to any disclaimer, the term of this patent is extended or adjusted under 35 U.S.C. 154(b) by 294 days.

(21) Appl. No.: 10/610,683

(22) Filed: Jul. 2, 2003

(65) Prior Publication Data

US 2004/0021624 A1 Feb. 5, 2004

(30) Foreign Application Priority Data

Jul. 9, 2002 (JP) ..... 2002-199431

(51) Int. Cl.
*H01J 1/62* (2006.01)
*H01J 63/04* (2006.01)

(52) U.S. Cl. ..... 313/495; 313/483

(58) Field of Classification Search ..... 313/495, 313/496, 497

See application file for complete search history.

(56) References Cited

U.S. PATENT DOCUMENTS 5,599,749 A * 2/1997 Hattori ..... 216/11
6,265,770 B1 * 7/2001 Uchiyama ..... 257/698
6,265,822 B1 * 7/2001 Kuroda et al. ..... 313/495
7,067,171 B1 * 6/2006 Ito ..... 427/77
2002/0036460 A1 * 3/2002 Takenaka et al. ..... 313/495

FOREIGN PATENT DOCUMENTS

JP 07-326306 12/1995
JP 2001-338528 12/2001

* cited by examiner

*Primary Examiner*—Sikha Roy
*Assistant Examiner*—Natalie K. Walford
(74) *Attorney, Agent, or Firm*—Antonelli, Terry, Stout & Kraus, LLP.

(57) ABSTRACT

Rupture of distance holding members, aback substrate or a front substrate attributed to atmospheric pressure is suppressed in a display device in which, between the back substrate having cathode lines and plate-member control electrodes and the front substrate, a large number of distance holding members, which maintain distance between the substrates, are mounted in an erect manner. At portions where the distance holding members are brought into contact with the back substrate and/or the front substrate, a buffering/fixing material, which is constituted of a buffering material having high resiliency and an adhesive, is interposed for dispersing the atmospheric pressure applied from the back substrate and the front substrate substantially uniformly. Further, the distance holding members are fixed between the back substrate and the front substrate by a heat treatment and a pressurizing step.

14 Claims, 11 Drawing Sheets

DISPLAY DEVICE

BACKGROUND OF THE INVENTION

The present invention relates to a display device of the type which utilizes an emission of electrons into a vacuum space, which is defined between a front substrate and a back substrate; and, more particularly, the invention relates to a display device in which there are arranged, with high accuracy, cathode lines having electron sources and control electrodes, which control the quantity of electrons emitted from the electron sources, which display device can exhibit stable display characteristics by maintaining a vacuum between the front substrate and the back substrate.

As a display device which exhibits a high brightness and high definition, color cathode ray tubes have been widely used conventionally. However, along with the recent request for higher quality in the generation of images in information processing equipment or television broadcasting, there has been an increased demand for planar displays (panel displays), which are light in weight and require a small space, while exhibiting a high brightness and a high definition.

As typical examples, liquid crystal display devices, plasma display devices and the like have been commercialized. Further, as display devices which can realize a higher brightness, it is expected that various kinds of panel-type display devices, including a display device which utilizes the emission of electrons from electron Sources into a vacuum (hereinafter, referred to as "an electron emission type display device" or "a field emission type display device"), and an organic EL display device, which is characterized by low power consumption, will be commercialized.

Among such panel type display devices, there are various types of field emission type display devices, including a display device having an electron emission structure as developed by C. A. Spindt et al, a display device having an electron emission structure of a metal-insulator metal (MIM) type, a display device having an electron emission structure which utilizes an electron emission phenomenon based on a quantum theory tunneling effect (also referred to as a "surface conduction type electron source"), and a display device which utilizes an electron emission phenomenon observed with a diamond film, a graphite film and carbon nanotubes and the like.

The field emission type display device includes a back substrate, on which cathode lines having electron-emission-type electron sources and control electrodes are formed on an inner surface thereof, and a front substrate, on which an anode and a fluorescent material are formed on an inner surface which faces the back substrate; wherein, both substrates are laminated to each other by inserting a sealing frame between the inner peripheries of both substrates, and the inside space between substrates is evacuated. Further, to set a distance between the back substrate and the front substrate to a given value, distance holding members are provided between the back substrate and the front substrate.

The distance holding members for maintaining the distance between the back substrate and front substrate are formed of thin plates made of glass or ceramics, which are disposed in an erect manner at positions spaced from the pixels. Here, as conventional examples of a display device provided with such distance holding members, attention is directed to Japanese Unexamined Patent Publication 326306/1995 and Japanese Unexamined Patent Publication 338528/2001.

SUMMARY OF THE INVENTION

FIG. 1(*a*) and FIG. 1(*b*) are schematic showing the overall constitution of a field emission type display device, wherein FIG. 1(*a*) is a plan view as viewed from a front substrate side, and FIG. 1(*b*) is a side view, which is obtained by viewing FIG. 1(*a*) in the direction of the arrow A therein. In FIG. 1(*a*) and FIG. 1(*b*), numeral 1 indicates a back substrate, numeral 2 indicates a front substrate, numeral 3 indicates an outer frame and numeral 4 indicates an exhaust pipe (in a sealed state). At the back substrate 1, on an insulating substrate which is preferably made of glass or ceramics, such as alumina, a plurality of cathode lines having electron sources extend in a first direction (x direction) and are juxtaposed in a second direction (y direction). Above these cathode lines, there are a plurality of control electrodes, which are insulated from the cathode lines, extend in the y direction and are juxtaposed in the x direction . Further, the outer frame 3 is interposed between the outer peripheries of the opposing back substrate 1 and front substrate 2 so as to define the distance therebetween, and the inside space, which is surrounded by the outer frame 3, is evacuated and sealed in vacuum. The front substrate 2 is stacked on the back substrate 1 in the z direction. After laminating the back substrate 1 and the front substrate 2 while interposing the outer frame 3 therebetween, the inside space between the substrates is evacuated using an exhaust pipe 4, and the inside space is sealed at a given degree of vacuum.

FIG. 2(*a*) and FIG. 2(*b*) are schematic diagrams showing an example of the back substrate, which constitutes a part of the display device shown in FIG. 1(*a*) and FIG. 1(*b*), wherein FIG. 2(*a*) is a plan view as seen from an upper side in the z direction, and FIG. 2(*b*) is a side view which is obtained by viewing FIG. 2(*a*) in the direction of the arrow B therein. Numeral 5 indicates cathode lines, numeral 6 indicates plate-member control electrodes, numeral 7 indicates electrode pressing members, and numeral 8 indicates an exhaust hole. In FIG. 2(*a*) and FIG. 2(*b*), numerals which are the same as those in FIG. 1(*a*) and FIG. 1(*b*) indicate identical functional parts. Here, the exhaust pipe shown in FIG. 2(*a*) and FIG. 2(*b*) is shown in a state before sealing. The plate-member control electrodes 6 are configured by arranging a large number of strip-like electrode elements having electron passing apertures in parallel. These plate-member control electrodes 6 have been proposed by the inventors of the present invention in the course of developing the present invention and do not constitute the prior art.

On an inner surface of the back substrate 1, cathode lines 5 are mounted. The cathode lines 5 extend in the x direction on the back substrate 1 and are juxtaposed in a large number in the y direction, which crosses the x direction. The cathode lines 5 are patterned by printing a conductive paste, including silver or the like. End portions of the cathode lines 5 are extended outside the outer frame 3 as cathode line pullout lines 5*a*. On the cathode lines 5, electron sources, such as metal-insulator-metal (MIM) type electron emission elements, electron emission structure (also referred to as a surface conductive electron source) elements which make use of an electron emission phenomenon generated-by a quantum theory tunneling effect, diamond films, graphite films or carbon nanotubes or the like (not shown in the drawing), are formed.

The plate-member control electrodes 6 shown in FIG. 2(*a*) and FIG. 2(*b*) are manufactured in a separate processing step as separate parts. Further, the plate-member control electrodes 6 are arranged above (front substrate side) and in the vicinity of the cathode lines 5 having electron sources, and they are fixed to the back substrate 1 using electrode pressing members 7, which are provided outside the display region and inside the outer frame 3 and are formed of an insulating body made of glass material or the like. Pullout lines are connected to the plate-member control electrodes 6 in the vicinity of the electrode pressing members 7, or in the vicinity of the outer frame 3, and these pullout lines are extended out to an outer periphery of the display device (not shown in the drawing). With this construction, pixels are formed in a matrix array on crossing portions between cathode lines 5 and the plate-member control electrodes 6, and the above-mentioned display region is formed on the pixels which are arranged in a matrix array. Here, it is also possible to make the outer frame 3 perform the function of the electrode pressing member 7.

Here, the emission quantity (including ON/OFF states) of electrons from the electron sources formed on the cathode lines 5 is controlled in response to the potential difference generated between the cathode lines 5 and the plate-member control electrodes 6. On the other hand, the front substrate 2 shown in FIG. 1(*a*) and FIG. 1(*b*) is made of an insulating material having, optical transmissivity, such as glass, wherein the front substrate 2 includes anodes and phosphors on an inner surface thereof. The phosphors are formed at locations corresponding to the pixels formed at the crossing portions of the cathode lines 5 and the plate-member control electrodes 6. Further, a light shielding layer (black matrix) is provided around the phosphors.

Vacuum is created by evacuating air from the space between the front substrate 2 and the back substrate 1, which is sealed by the outer frame 3, through the exhaust hole 8 via the exhaust pipe 4, so that the degree of vacuum of $10^{-2}$ to $10^{-5}$ Pa, for example, is obtained. Electron passing apertures (not shown in the drawing) are formed in each crossing portion of the plate-member control electrode 6 and the cathode line 5 so as to allow electrons emitted from the electron source formed on the cathode line 5 to pass therethrough toward the front substrate side (anode side). It is necessary to mount the plate-member control electrodes 6 on the back substrate 1 on which the cathode lines 5 are formed and over the whole display region with a given gap with respect to the cathode lines 5.

The distance holding members are usually formed of a large number of thin glass plates or the like, which are arranged vertically (z direction) between the plate-member control electrodes 6, such that they form partition walls between the back substrate and the front substrate. Accordingly, the assembling of the distance holding members requires a delicate and sophisticated expertise. Further, the stress which accompanies the vacuum pressure is applied to the distance holding members from the front substrate and the back substrate; and, hence, unless a plurality of the distance holding members are arranged to receive the stress uniformly, a stress concentration occurs on some distance holding members, thus giving rise to a rupture of the distance holding members per se, the front substrate or the back substrate.

The above-mentioned Japanese Unexamined Patent Publication 326306/1995, which provides one of the countermeasures to cope with such a drawback, proposed the use of a material which is obtained by applying a paste, having silver as a main component, as a resilient material between distance holding members and a substrate and baking the paste, or an inorganic adhesive having a low Young's modulus ("ARON Ceramics", a product of Toa Gosei Kagaku Ltd. in the embodiment) is used. Further, in the above-mentioned Japanese Unexamined Patent Publication 338528/2001, this as an arrangement in which conductive frits are interposed between the distance holding members and the substrates. However, the Young's modulus which these materials possess as a resilient material is not considerably large (flexible) compared to that possessed by the glass plate or the ceramics plate which constitutes the distance holding members, and, hence, the stress dispersion effect is limited. In addition, when a conductive paste is used on the back substrate on which cathode lines and control electrodes are formed, there arises a problem with respect to the insulating property.

Further, mounting of the distance holding members requires the arrangement of the distance holding members between the back substrate and the front substrate with high accuracy and with uniformity; and, at the same time, it is necessary to ensure that the stress attributed to atmospheric pressure is uniformly applied to a large number of distance holding members. However, in the above-mentioned conventional schemes, only the consideration that the distance holding members should be mounted in an erect manner between the back substrate and the front substrate is taken into account. That is, the conventional methods do not take account the mounting of the distance holding members in a display device in which control electrodes are arranged between the back substrate and the front substrate.

Accordingly, it is an object of the present invention to mount a large number of distance holding members with high accuracy in a display device in which control electrodes are arranged between a back substrate and a front substrate.

Further, it is another object of the present invention to provide a highly reliable display device, in which it is ensured that stress attributed to atmospheric pressure is substantially uniformly applied to a large number of distance holding members, so as to suppress rupture of the distance holding members, the back substrate or the front substrate.

To achieve the above-mentioned objects, in accordance with the present invention, with respect to a large number of distance holding members, which are arranged in an erect manner between a back substrate and a front substrate so as to hold and maintain the distance between both substrates, buffering/fixing materials are interposed at portions thereof which are brought into contact with the above-mentioned back substrate and/or front substrate, which buffering/fixing materials have a high resiliency sufficient to substantially uniformly disperse the atmospheric pressure applied thereto from the back substrate and the front substrate, and each of which is constituted of a buffer material and an adhesive. These distance holding members are fixed between the back substrate and the front substrate by the application of heat treatment and pressurizing steps.

Due to such a constitution of the present invention, the buffer material is fixed such that pressure is applied to many distance holding members in the above-mentioned heat treatment and pressurizing steps. As a result, it is possible to suppress a rupture of the distance holding members, the back substrate or the front substrate. Examples of typical constitutions of the present invention are as follows.

(1) A display device comprises:

a front substrate on which anodes and phosphors are formed on an inner surface thereof;

a back substrate on which there are a plurality of cathode lines, which extend in a first direction and are juxtaposed in a second direction, which crosses the first direction, and have electron sources, and a plurality of control electrodes, which cross the cathode lines in a non-contact manner within a display region, extend in the above-mentioned second direction, are juxtaposed in the above-mentioned first direction, and have electron passing apertures which allow electrons from the electron sources to pass therethrough, the back substrate being arranged to face the front substrate in an opposed manner with a given distance therebetween; and distance holding members being sandwiched between the front substrate and the back substrate in an erect manner to hold the distance between the front substrate and the back substrate to a given distance; wherein a buffering/fixing material is provided between at least one of the front substrate and the back substrate and the distance holding members, and the buffering/fixing material is formed by mixing an adhesive with a highly resilient material, which has high resiliency at the time of assembling and dissipates in a baking step.

(2) In the above-mentioned constitution (1), the control electrodes are constituted of plate-members, which are formed by arranging a plurality of strip-like electrode elements in parallel.

(3) In the above-mentioned constitution (2), the display device includes an outer frame, which is interposed between the front substrate and the back substrate, such that the outer frame surrounds the display region so as to maintain the given distance, and the display device further includes electrode pressing members, which fix both end regions of the strip-like electrode elements which constitute the control electrodes, to the back substrate, outside the display region and inside the outer frame.

(4) In the above-mentioned constitutions (1) to (3), a low-temperature decomposing foamed resin is used as the above-mentioned highly resilient material.

(5) In the above-mentioned constitution (4), urethane is used as the above-mentioned low-temperature decomposing foamed resin.

(6) In any one of the above-mentioned constitutions (1) to (5), a low melting-point glass is used as the adhesive.

(7) A display device comprises:

a front substrate on which anodes and phosphors are formed on an inner surface thereof;

a back substrate on which there are a plurality of cathode lines, which extend in a first direction and are juxtaposed in a second direction, which crosses the first direction, and has electron sources, and a plurality of control electrodes, which cross the cathode lines in a non-contact manner within a display region, extend in the above-mentioned second direction, are juxtaposed in the above-mentioned first direction, and have electron passing apertures which allow electrons from the electron sources to pass therethrough, the back substrate being arranged to face the front substrate in an opposed manner with a given distance therebetween; and distance holding members being sandwiched between the front substrate and the back substrate in an erect manner to hold the distance between the front substrate and the back substrate to a given distance; wherein a buffering/fixing material is provided between at least one of the front substrate and the back substrate and the distance holding members, and the buffering/fixing material is formed by mixing an adhesive with a highly resilient material, which has high resiliency and is present as a reinforcing material after a baking step.

(8) In the above-mentioned constitution (7), the control electrodes are constituted of plate members which are formed by arranging a plurality of strip-like electrode elements in parallel.

(9) In the above-mentioned constitution (8), the display device includes an outer frame which is interposed between the front substrate and the back substrate, such that the outer frame surrounds the display region, so as to maintain the given distance, and the display device further includes electrode pressing members, which fix both end regions of the strip-like electrode elements which constitute the control electrodes, to the back substrate, outside the display region and inside the outer frame.

(10) In the above-mentioned constitutions (7) to (9), heat-resistant fibers are used as the above-mentioned highly resilient material.

(11) In the above-mentioned constitution (10), aramid-based fibers are used as the heat-resistant fibers.

(12) In any one of the above-mentioned constitutions (7) to (11), a low melting-point glass is used as the adhesive.

Due to the above-mentioned respective constitutions, the atmospheric pressure which is applied to a large number of distance holding members which are arranged between the back substrate and the front substrate in an erected manner becomes substantially uniform so that it is possible to obviate the rupture of the back substrate, the front substrate or the distance holding members. Here, as the highly resilient material, besides the materials described above, a plastic material formed of foamed polyethylene or acetate fibers can be used.

DESCRIPTION OF THE PREFERRED EMBODIMENTS

Preferred embodiments of the present invention will be explained in detail hereinafter in conjunction with the drawings.

Embodiment 1

Figure 1:
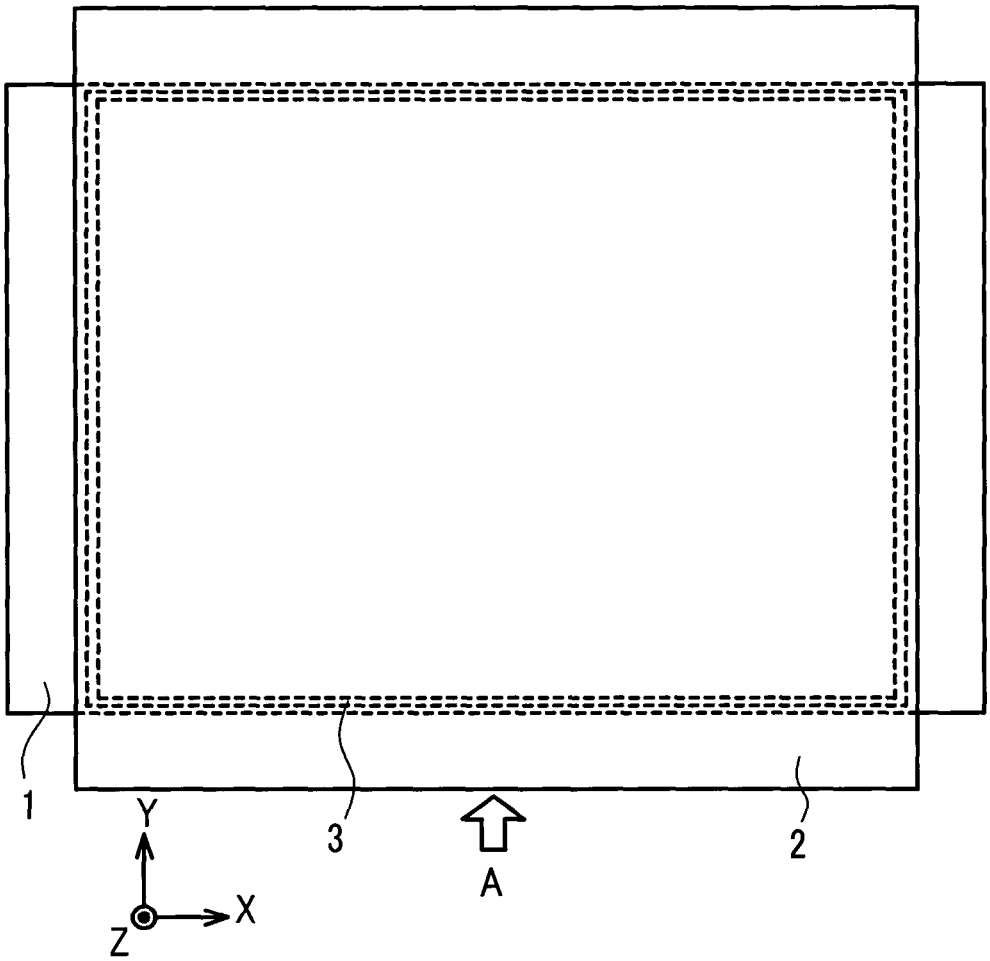
FIG. 1(*a*) is a plan view and, FIG. 1(*b*) is a side view as seen in the direction of arrow A in FIG. 1(*a*), showing the overall constitution of a field emission type display device.
Figure 1:
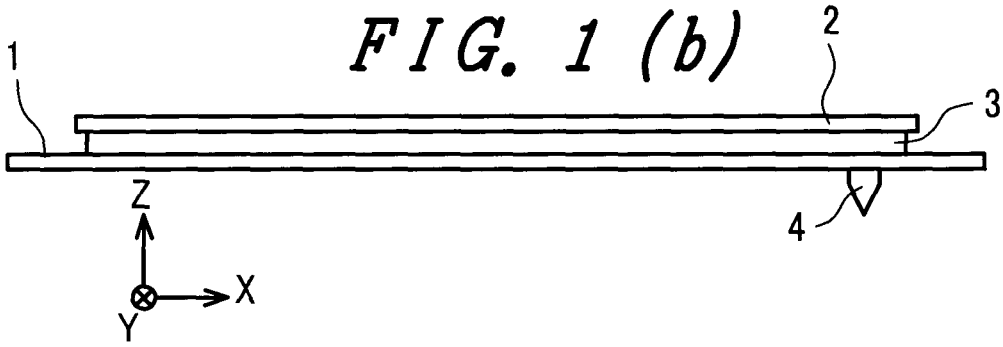
Figure 2:
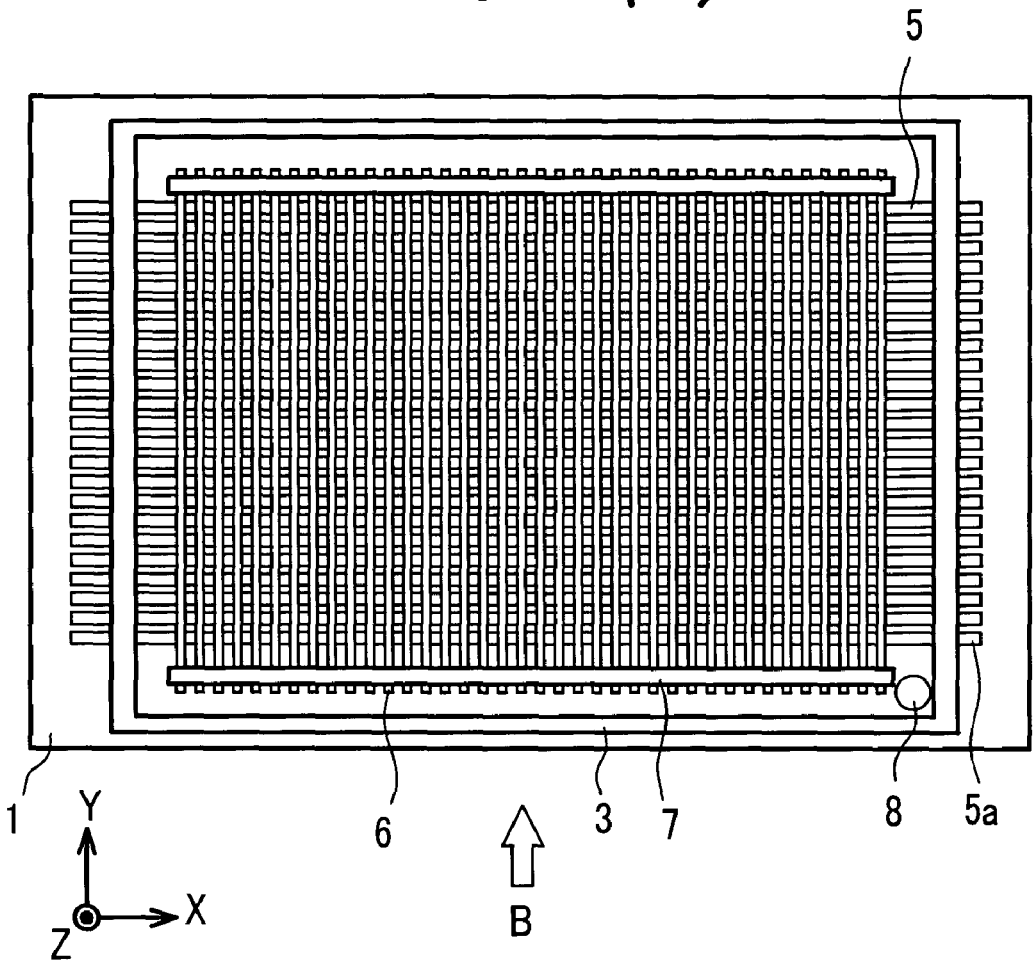
FIG. 2(*a*) is a plan view and, FIG. 2(*b*) is a side view as seen in the direction of arrow B in FIG. 2(*a*), showing an example of a back substrate, which constitutes the display device shown in FIG. 1(*a*) and FIG. 1(*b*).
Figure 2:
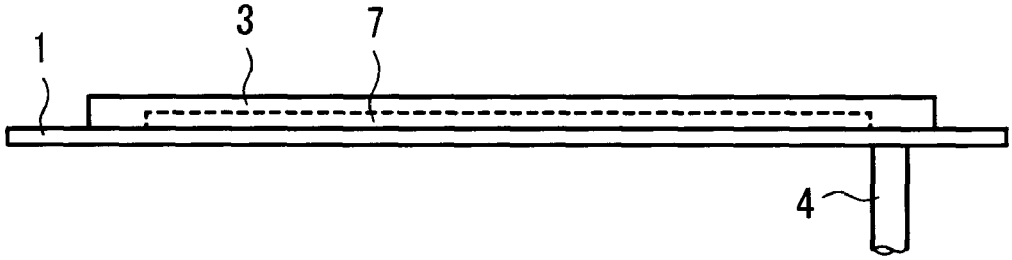
Figure 3:
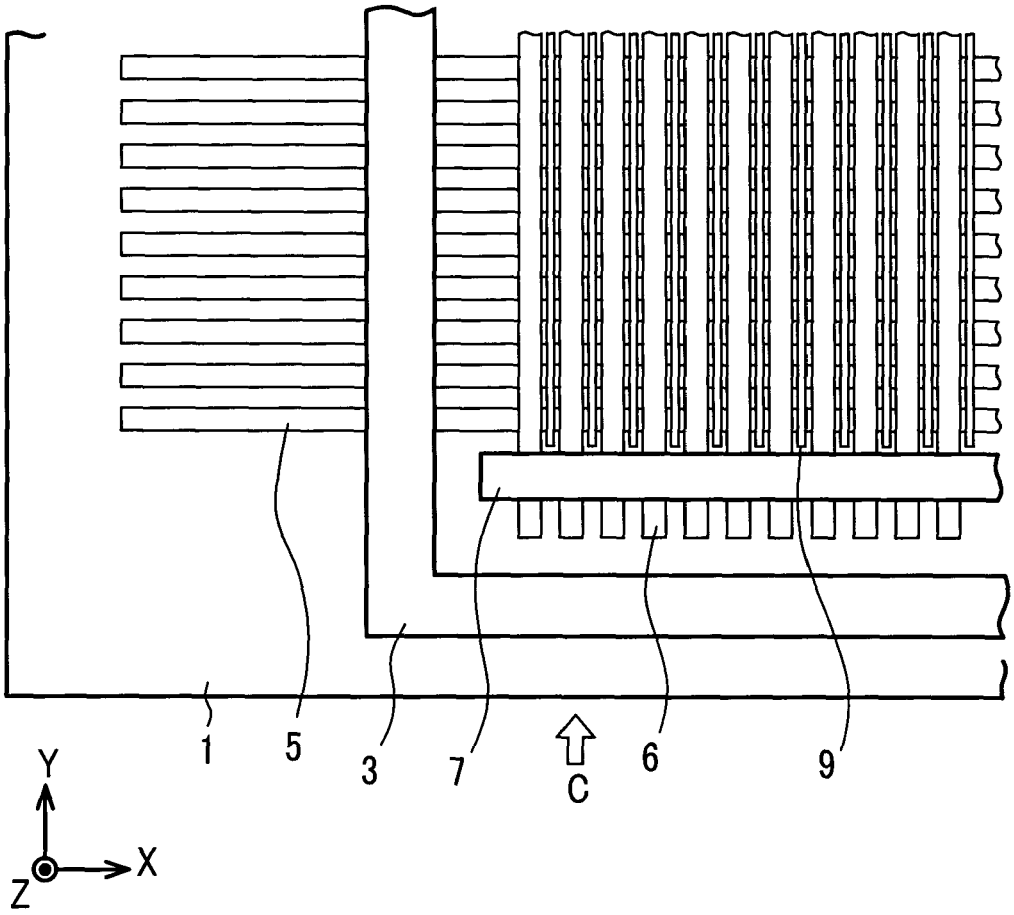
FIG. 3(*a*) is a plan view and, FIG. 3(*b*) is a side view as seen in the direction of arrow C in FIG. 3(*a*), showing a first embodiment of the display device according to the present invention.
Figure 3:
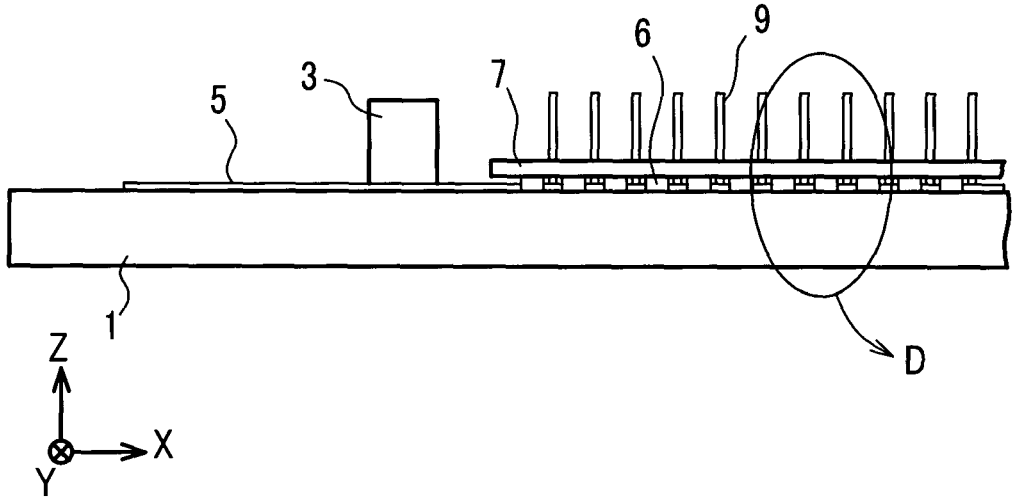

FIG. 3(*a*) and FIG. 3(*b*) show a first embodiment of a display device according to the present invention. FIG. 3(*a*) and FIG. 3(*b*) illustrate the mounting structure of distance holding members, wherein FIG. 3(*a*) is a plan view of part of a back substrate in a state in which the front substrate is removed, and FIG. 3(*b*) is a side view of the mounting structure as viewed in the direction of the arrow C in FIG. 3(*a*). In these drawings, numeral 9 indicates distance holding members, and the other numerals used in FIG. 3(*a*) and FIG. 3(*b*), which are the same as numerals used in FIG. 2, indicate identical functional parts. The distance holding members 9 are arranged between adjacent plate-member control electrodes 6.

Figure 4:
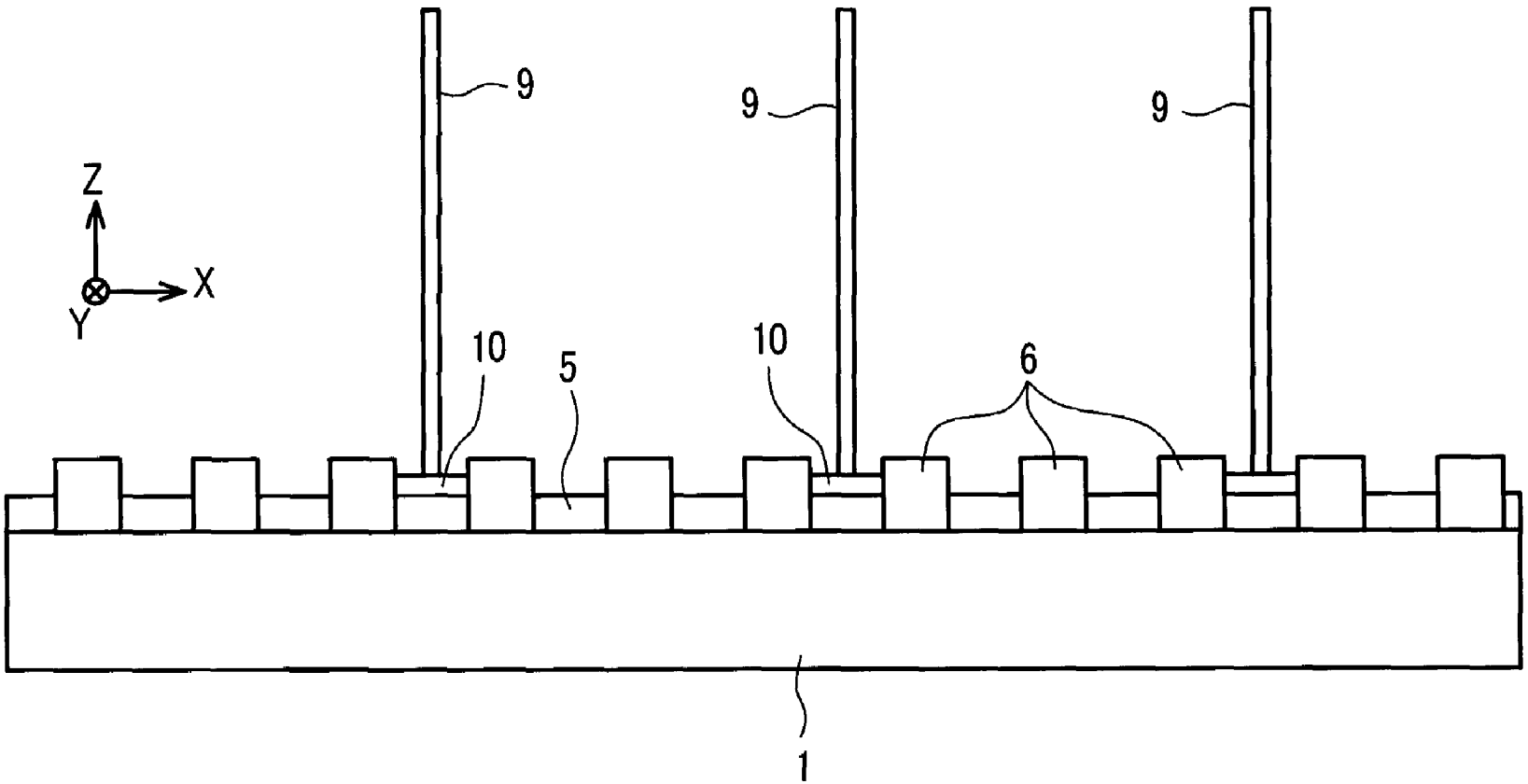
FIG. 4 is an enlarged view of the portion D in FIG. 3(*b*).

Further, FIG. 4 is an enlarged view of the portion D in FIG. 3(*b*). In FIG. 4, numeral 10 indicates a buffering/fixing material, which is formed by mixing urethane resin, serving as low-temperature decomposing foamed resin having high resiliency, with a low melting glass, serving as an adhesive. The urethane resin has a property in which it dissipates at a temperature of about 350° C. The buffering/fixing material 10 is applied onto the cathode lines 5 formed on the back substrate 1 and along and between the plate-member control electrodes 6. On the buffering/fixing material 10, one end of the distance holding members 9 is mounted, using a jig similar to a jig which will be described later. In this embodiment, the buffering/fixing material 10 is arranged at intervals of every three plate-like member control electrodes 6 corresponding to three unit pixels. These three unit pixels correspond to R, G, B colors which constitute one trio pixel of a color display. However, the positions where distance holding members 9 are mounted are not limited to the above-described positions.

Although not shown in the drawing, the other end of the distance holding members 9 are brought into contact with the front substrate. Although the other end of the distance holding members 9 may be fixed using only an adhesive, such as frit glass or the like, it is needless to say that a similar buffering/fixing material 10 can be interposed between the distance holding members 9 and the front substrate.

Since the distance holding members 9 are joined to the back substrate 1 by way of the buffering/fixing material 10 in a state in which the buffering/fixing material 10 is applied to the back substrate side, as opposed to a case in which only an adhesive is directly applied to the distance holding members 9, the quantity of the buffering/fixing material 10 being applied can be made uniform. Accordingly, a large number of distance holding members 9 can be temporarily mounted in an erect manner on the back substrate by way of the buffering/fixing material 10, which is applied in a substantially equal quantity and over substantially the whole surface thereof. The buffering/fixing material 10 may be baked temporarily in this state.

Figure 5:
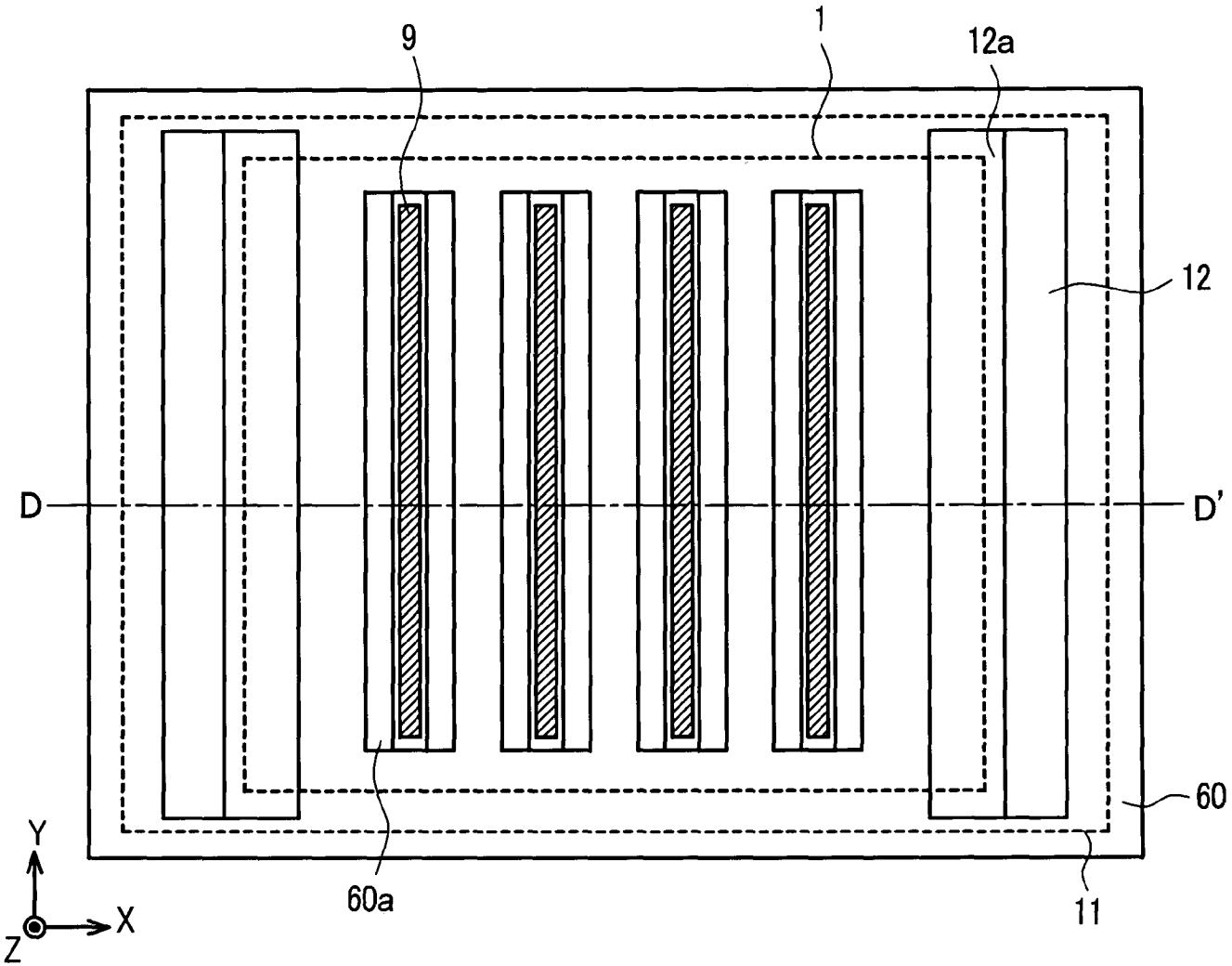
FIG. 5 is a diagram showing an assembling jig for use in mounting the distance holding members.
Figure 6:
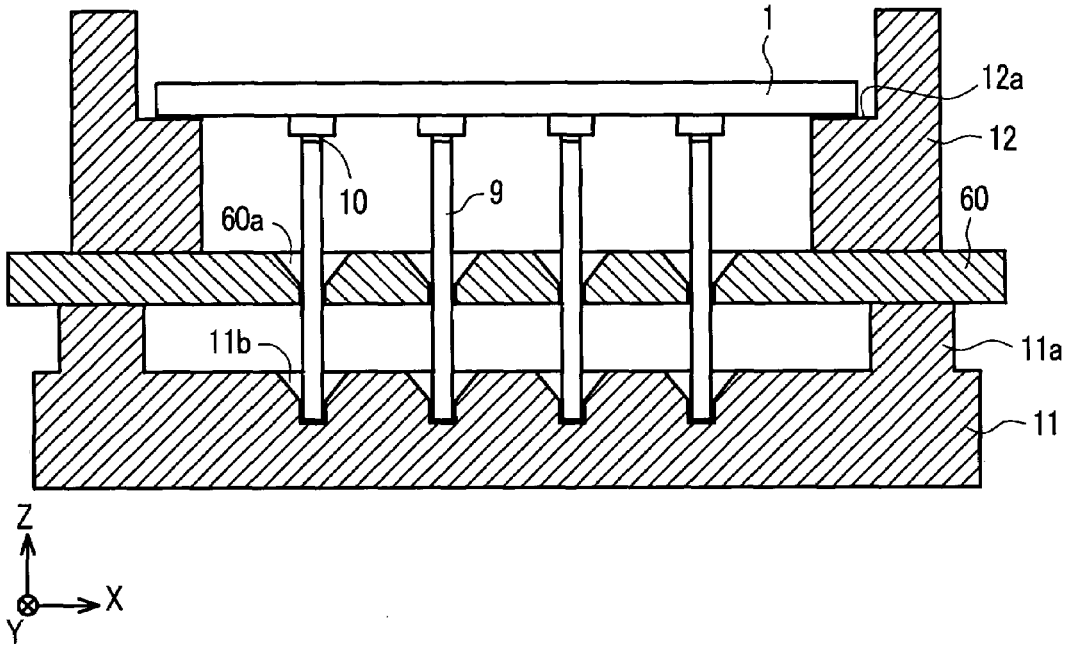
FIG. 6 is a cross-sectional view taken along a line D-D' in FIG. 5.

FIG. 5 shows an assembling jig which is used for mounting the distance holding members. Further, FIG. 6 is a cross-sectional view taken along a line D-D' in FIG. 5. In FIG. 5 and FIG. 6, numeral 11 indicates a lower-side jig member, numeral 11*a* indicates projections, numeral 12 indicates an upper-side jig member, and numeral 12*a* indicates stepped portions. Numerals which are the same as those in the previously-mentioned drawings indicate identical functional parts. In FIG. 5 and FIG. 6, the details of the back substrate 1 are omitted. A plate-member control electrode master plate 60 may be formed of plate-member control electrodes of an actual device. The plate-member control electrode master plate 60 is manufactured using a photo mask, which is also used for manufacturing the plate-member control electrodes 6.

Figure 7:
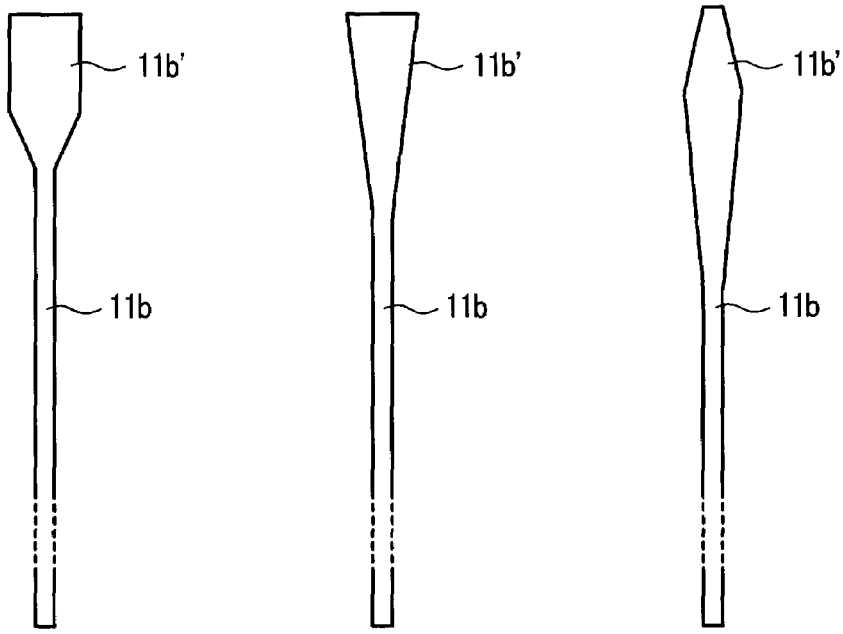
FIG. 7(*a*), FIG. 7(*b*) and FIG. 7(*c*) are diagrams showing examples of the shape of a slit formed in the assembling jig shown in FIG. 5.
Figure 8:
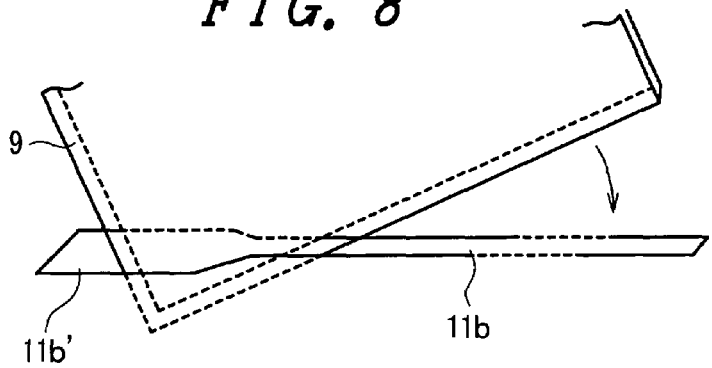
FIG. 8 is a diagram showing a state in which the distance holding member is aligned with the slit shown in FIG. 7(*a*).

FIG. 7(*a*), FIG. 7(*b*) and FIG. 7(*c*) are diagrams showing examples of the shape of a slit formed in the assembling jig shown in FIG. 5, while FIG. 8 is a diagram showing the state in which the distance holding member is aligned with the slit shown in FIG. 7(*a*). In the lower-side jig member 11, which constitutes a part of the assembling jig of the present invention, slits 11*b* are formed at given intervals to enable the easy insertion of the thin distance holding members 9; and, for this purpose, they have upper portions thereof which are widened to receive these members 9 and lower portions to facilitate the vertical disposition of the distance holding members 9. The slit 11*b* has a planar shape as shown in FIG. 7(*a*), FIG. 7(*b*) or FIG. 7(*c*). That is, the slit fib has a wide opening portion 11*b*' at one end portion-thereof. In inserting the distance holding member 9 into the slit 11*b* formed in the lower-side jig member 11, as shown in FIG. 8, a corner of the distance holding member 9 is first aligned with and inserted into the wide opening portion 11*b*'; and, subsequently, the whole distance holding member 9 is rotated down and inserted into the slit 11*b*, as indicated by the arrow.

By providing such a slit shape, it is possible to easily insert the distance holding member 9 into the slit 11*b* formed in the lower-side jig member 11. Here, the position where the wide opening portion 11*b*' is formed in the slit 11*b* is not limited to the end portion of the slit 11*b* as shown in FIG. 7(*a*), FIG. 7(*b*) and FIG. 7(*c*), and the wide opening portion 11*b*' also may be formed in a proper intermediate portion of the slit 11*b*.

Returning to FIG. 5 and FIG. 6, the plate-member control electrode master plate 60 is mounted on projections ha of the lower-side jig member 11, and the upper-side jig member 12, which has a stepped portion 12*a*, is mounted on the plate-member control electrode master plate 60 so as to hold the plate-member control electrode master plate 60. The plate-member control electrode master plate 60 has the periphery thereof fixed by a frame body. A large number of gaps 60*a*, which correspond to an interval between strip-like electrode elements of an actual display device, are formed in the plate-member control electrode master plate 60. The gaps 60*a* and the slits 11*b* formed in the lower-side jig member 11 are aligned with each other in the z direction. The back substrate 1, to which the distance holding members 9 are temporarily fixed, is mounted on the stepped portions 12*a* of the upper-side jig member 12. Alternatively, it is possible to align and overlap the back substrate 1 on the stepped portions 12*a* of the upper-side jig member 12 after arranging the distance holding members described below.

Here, the distance holding members 9 are inserted into the slits 11*b* formed in the lower-side jig 11 using the procedure explained in conjunction with FIG. 8 by allowing the distance holding members 9 to pass through the gaps 60*a* formed in the plate-member control electrode master plate 60. Further, with respect to the gaps 60*a* formed in the plate-member control electrode master plate 60, by slightly widening the gap on the insertion side, as seen in FIG. 6, the insertion of the distance holding member 9 is facilitated.

The length of the distal end portion of the distance holding member 9 which is projected into the slit 11*b* formed in the lower-side jig 11 from the gap 60*a* formed in the plate-member control electrode master plate 60 is preferably set to ¼ to ⅓ of the height of the distance holding member 9 to take the operability into consideration. In this type of field emission type display device, electrons are emitted with the intensity of an electric field of 3V/μm; and, hence, provided that a distance of about 3 mm is ensured between the plate-member control electrode 6 and the anode formed on the front substrate, it is possible to apply a high voltage of about 10 kV. Accordingly, the above-mentioned projection quantity is set to a value slightly less than 1 mm.

The back substrate 1 is set into the jig as shown in FIG. 6 and is subjected to a heat treatment while pressure is applied to the whole surface from above the back substrate 1. In this pressuring and heating treatment, due to a buffer action of urethane resin possessed by the buffering/fixing material 10, the pressure is uniformly applied to a plurality of the distance holding members 9; and, thereafter, the distance holding members 9 are fixed to the back substrate 1 due to melting and solidifying of the frit glass contained in the buffering/fixing material 10. Simultaneously, the urethane resin is dissipated. Since the frit glass starts softening at a temperature in the vicinity of 350° C., when the urethane resin is decomposed and loses its resiliency, the paste-like frit glass plays the role of a cushion material between the distance holding members 9 and the back substrate 1. Further, after performing the heat treatment at 450° C. for about 30 minutes, the temperature is lowered so as to solidify the frit glass. Thereafter, the back substrate 1, to which one ends of the distance holding members 9 are fixed, is removed from the jig.

Figure 9:
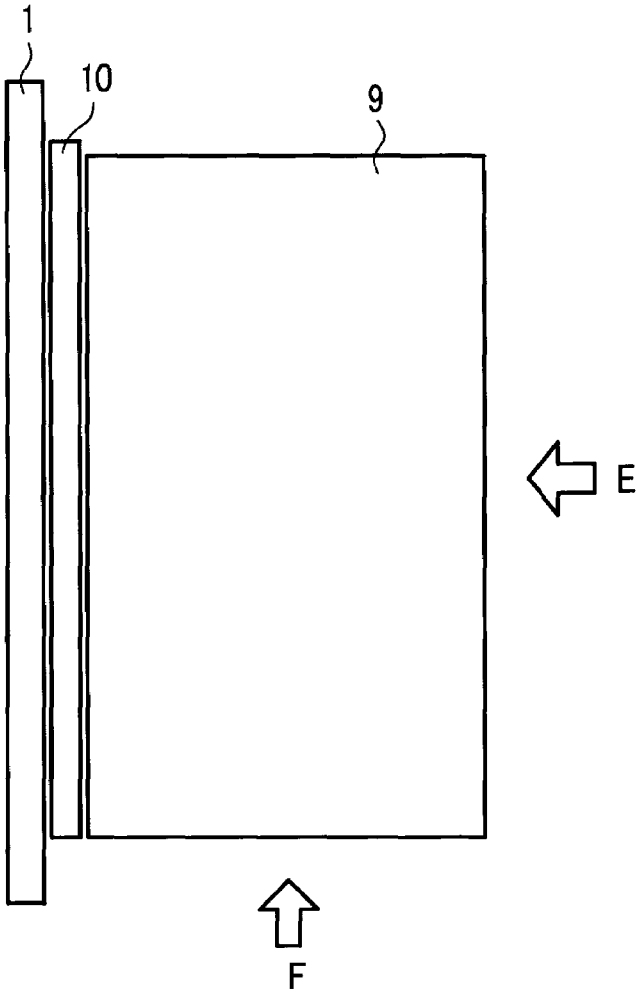
FIG. 9(*a*) is a plan view, and FIG. 9(*b*) and FIG. 9(*c*) are side views as seen in the direction of arrows E and F, respectively, in FIG. 9(*a*), showing the constitution of the back substrate to which the distance holding members are fixed.
Figure 9:
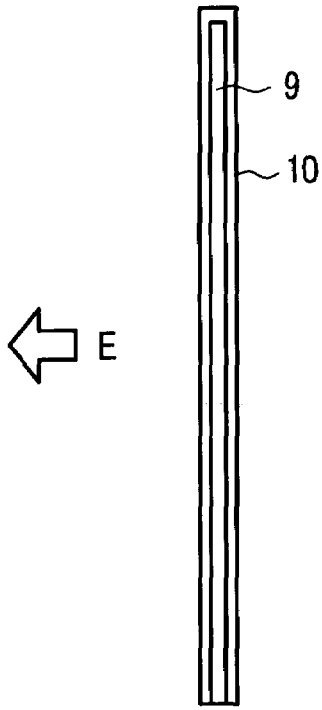
Figure 9:
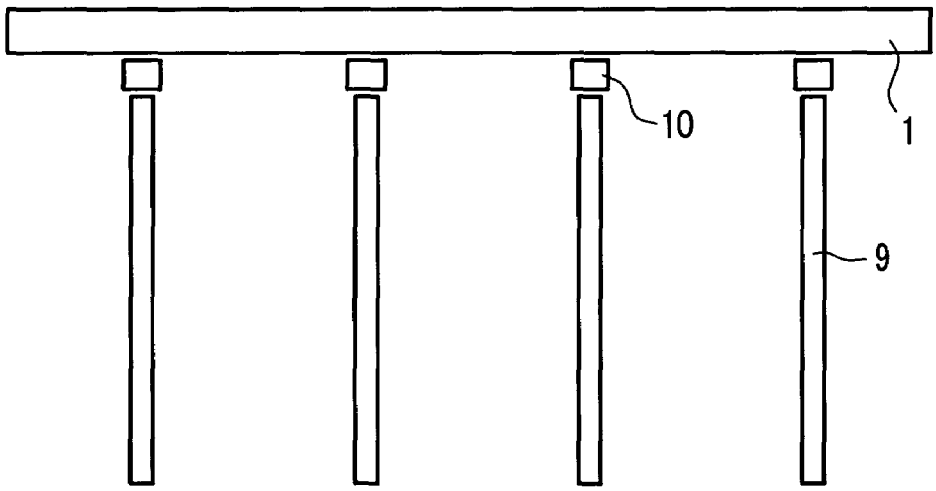

FIG. 9(*a*), FIG. 9(*b*) and FIG. 9(*c*) show the back substrate to which the distance holding members are fixed, wherein FIG. 9(*a*) is a plan view of the distance holding member, FIG. 9(*b*) is a side view as seen from the direction of the arrow B in FIG. 9(*a*), and FIG. 9(*c*) is a side view as viewed from the direction of the arrow F in FIG. 9(*a*). Although the buffering/fixing material 10 has a thickness of about 1 mm before baking, in a state after solidifying, as shown in FIG. 9(*a*), FIG. 9(*b*) and FIG. 9(*c*), the thickness becomes about 0.1 mm. In applying the buffering/fixing material 10 to the back substrate 1 side and mounting and fixing the distance holding members 9 on the back substrate 1, it is desirable to make the area of application of the buffering/fixing material 10 broader than the cross section of the distance holding member 9.

Figure 10:
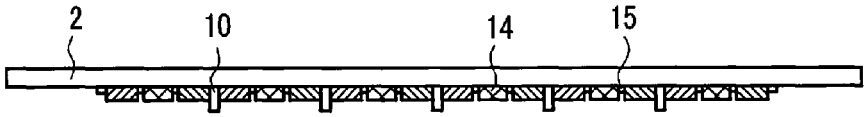
FIG. 10(*a*) is a plan view, and FIG. 10(*b*) is a section taken along line G-G' in FIG. 10(*a*), showing an example of the front substrate in the first embodiment of the present invention.
Figure 10:
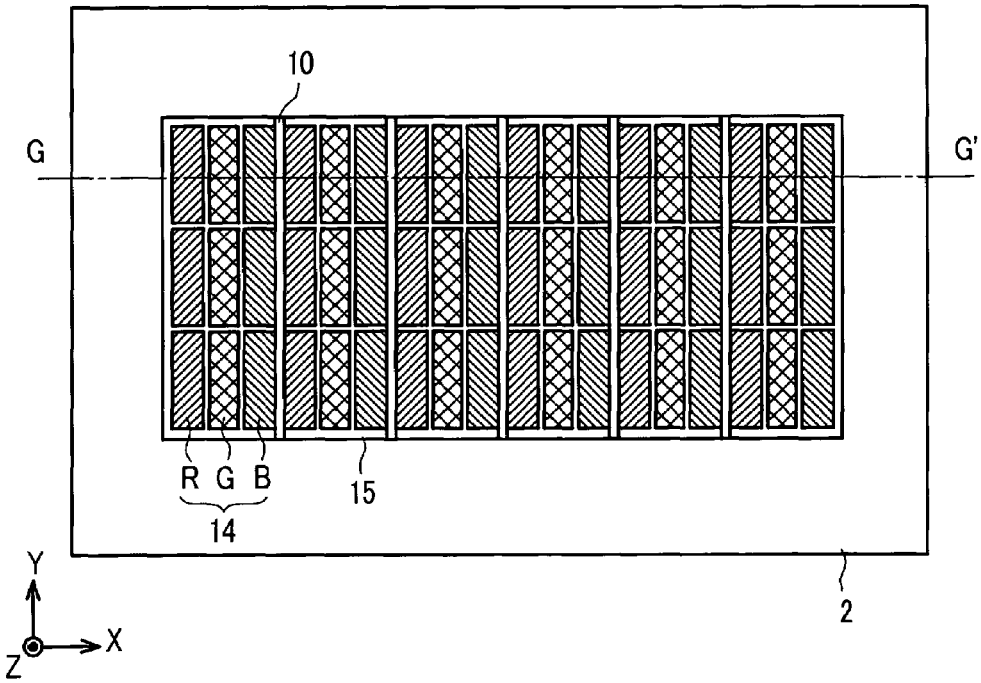
Figure 11:
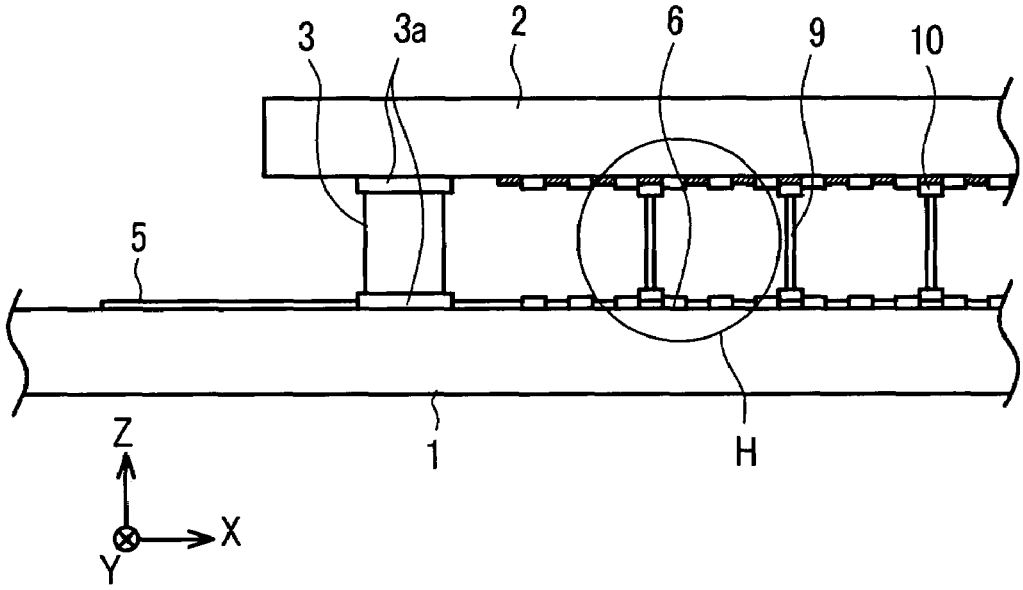
FIG. 11 is a cross-sectional view of part of the display device in which the front substrate is assembled and integrally formed with the back substrate.
Figure 12:
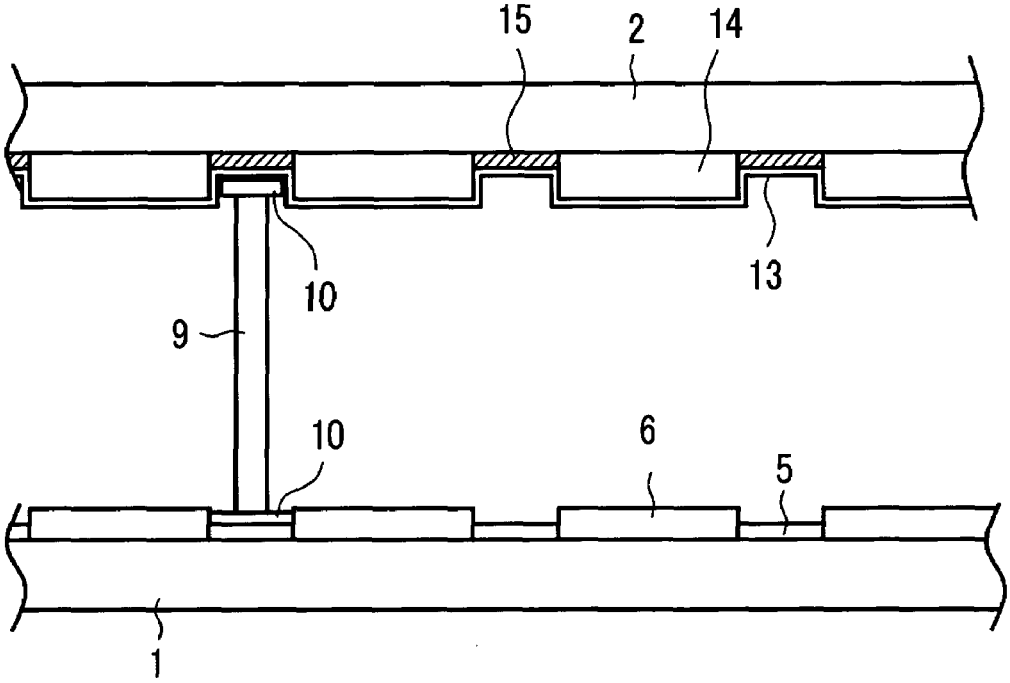
FIG. 12 is an enlarged view of the portion H in FIG. 11.

FIG. 10(*a*) and FIG. 10(*b*) show an example of the front substrate of the first embodiment of the present invention. FIG. 10(*a*) is a plan view, and FIG. 10(*b*) is a cross-sectional view taken along a line G-G' in FIG. 10(*a*). Further, FIG. 11 is a cross-sectional view of part of a display device in which a front substrate is integrally incorporated into a back substrate, and FIG. 12 is an enlarged view of a portion H in FIG. 11. In FIG. 11 and FIG. 12, numeral 2 indicates the front substrate, numeral 13 indicates anodes, numeral 14 indicates phosphors and numeral 15 indicates a light shielding film (black matrix). The phosphors 14 constitute one trio pixel with a color arrangement of red (R), green (G), and blue (B). The respective colors are defined or partitioned by the black matrix 15. In this embodiment, a buffering/fixing material 10 for mounting distance holding members 9 is applied for every trio pixel (R, G, B).

For example, one trio pixel (R, G, B) of the phosphors 14 formed on the front substrate 2 is about 1 mm, and a gap of about 0.1 mm may be provided between the phosphors (phosphor elements) of respective colors. Assuming that the distance holding member 9, having a thickness of about 50 μm, is mounted in the gap, to ensure the tolerance of 10 to 15 μm for preventing the complete removal of the distance holding member 9 from an application region of the buffering/fixing material 10, it is desirable to set an application width of the buffering/fixing material 10 to 70 to 80 μm. Further, it is desirable to set an application length of the buffering/fixing material 10 to about a length of the distance holding member 9+10 mm, provided that the alignment tolerance between the buffering/fixing material 10 and the distance holding member 9 is, respectively, 5 mm at both ends.

The front substrate 2, shown in FIG. 10(*a*), is laminated to the back substrate 1, to which the distance holding members 9 shown in FIG. 9 are fixed by way of an outer frame. The outer frame 3, the back substrate land the front substrate 2 are adhered to each other using an adhesive 3*a*, such as frit glass. Here, other ends of the distance holding members 9, provided to the back substrate 1 shown in FIG. 9, are aligned with the buffering/fixing material 10 that is applied to the front substrate 2 side shown in FIG. 10. The average particle size of the phosphors formed on the front substrate 2 is about 2 to 5 μm, and the film thickness of the phosphors is about 10 μm. The anode 13, which is formed on the front substrate 2 so as to cover the front substrate 2, is formed of, for example, a thin aluminum film (so-called metal back). The film thickness of the anode 13 is about 70 nm to 100 nm when the anode voltage is about 10 kV.

FIG. 11 is a schematic cross-sectional view showing part of the display device formed by laminating the back substrate 1 and the front substrate 2 by way of the outer frame 3. Further, FIG. 12 is an enlarged view of a portion H in FIG. 11. One end of the distance holding members 9 is mounted in an erect manner on the cathode lines 5 by way of the buffering/fixing material 10 that is disposed between the neighboring plate-member control electrodes 6 formed on the back substrate 1, while the other end of the distance holding members 9 is held by the buffering/fixing material 10 provided to the anode 13 at positions of the black matrix 15 which are arranged between the phosphors 14 formed on the front substrate 2. In this constitutional example, a distance holding member 9 is mounted for every set of one trio color pixel (R, G, B). The mounting number of distance holding members 9 is calculated based on the strength of the distance holding members 9. For example, when glass having a width of about 100 μm is used, the distance holding members 9 may be arranged at an interval of 35 mm; while, when glass having a width of about 50 μm is used, the distance holding members 9 may be arranged at an interval of 16 mm.

Heating is performed in this state, while pressurizing the back substrate 1 and the front substrate 2 in opposing directions; and, thereafter, the temperature is lowered so as to make the buffering/fixing material 10 fix the distance holding members 9, such that a uniform stress is applied between both substrates 1, 2. Thereafter, a display device is completed through a discharging step and an aging step.

According to this embodiment, a large number of the distance holding members 9 can be mounted with high accuracy in the display device, in which the plate-member control electrodes 6 are arranged between the back substrate 1 and the front substrate 2. Further, the stress attributed to the atmospheric pressure is uniformly applied to a large number of the distance holding members 9; and, hence, rupture of the distance holding members 9, the back substrate 1 or the front substrate 2 can be suppressed, whereby it is possible to obtain a highly reliable display device.

Embodiment 2

In the above-mentioned first embodiment, as the buffering/fixing material 10, a material which is prepared by mixing an adhesive with a highly resilient material made of foamed resin, such as urethane resin, which possesses high resiliency during assembling and dissipates in the baking process, is used. The second embodiment of the present invention is characterized in that, in place of the foamed resin which dissipates in the baking step, a buffering/fixing material which is prepared by mixing an adhesive with a resilient material made of a heat-resistant aramid-based resin fibers or the like, which do not dissipate by heating at a high temperature in a short time, is used.

When the fibers made of heat-resistant aramid-based resin (product name: Kevlar or the like) are used as the resilient material, a sheet made of aramid-based resin fibers is placed between the distance holding members 9 and the back substrate 1 and/or the front substrate 2, and an adhesive, such as frit glass, having a low melting point, is applied to a periphery and an upper portion thereof. Alternatively, a sheet made of aramid-based resin fibers, in which the adhesive is impregnated, is inserted between the distance holding members 9 and the back substrate 1 and/or the front substrate 2. Ensuing pressurizing and heat treatment are performed in the same manner as the previous embodiment. Due to the heat treatment, the aramid-based resin fibers remain at fixing portions as a reinforcing material.

Also, according to this embodiment, a large number of the distance holding members 9 can be mounted with high accuracy in the display device, in which the plate-member control electrodes 6 are arranged between the back substrate 1 and the front substrate 2. Further, the stress attributed to atmospheric pressure is uniformly applied to a large number of the distance holding members 9; and, hence, rupture of the distance holding members 9, the back substrate 1 or the front substrate 2 can be suppressed, thereby it is possible to obtain a highly reliable display device.

Embodiment 3

Figure 13:
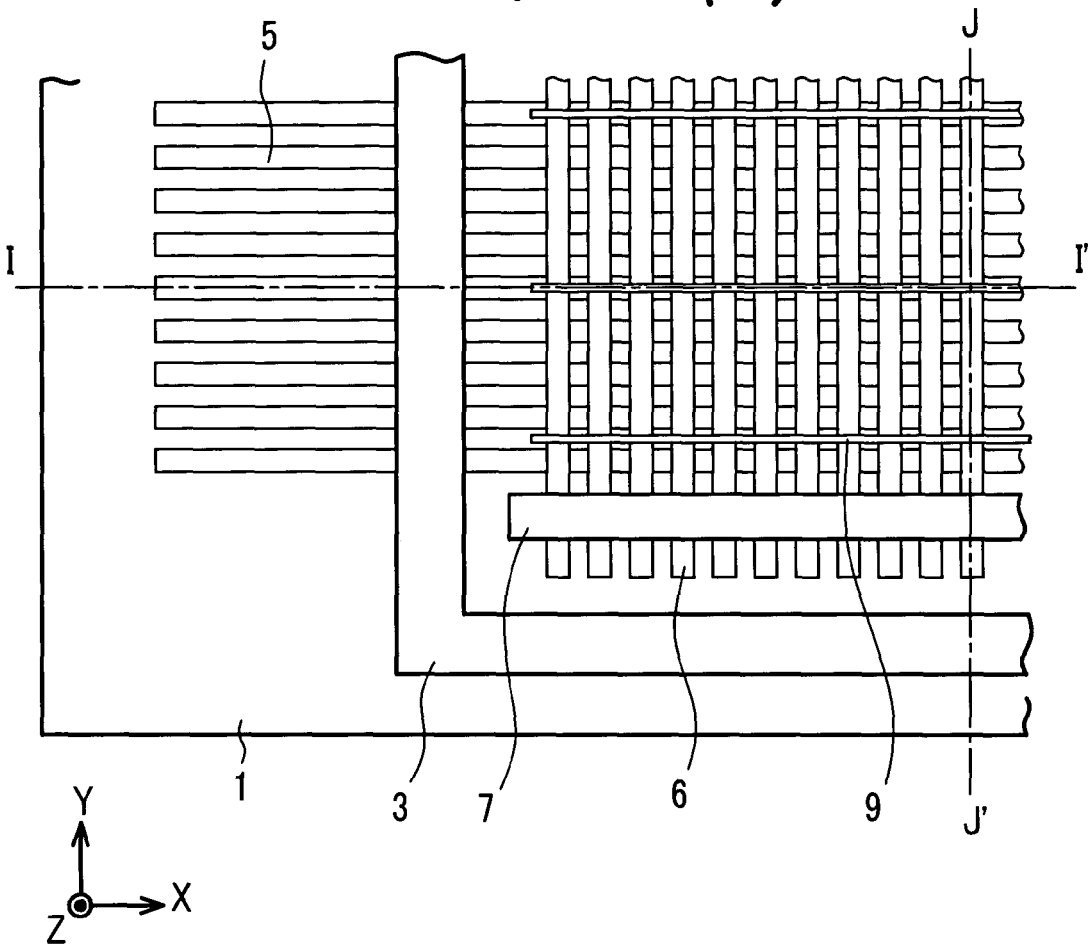
FIG. 13(*a*) is a plan view and, FIG. 13(*b*) is a section taken along line I-I' in FIG. 13(*a*), showing a third embodiment of the display device according to the present invention.
Figure 13:
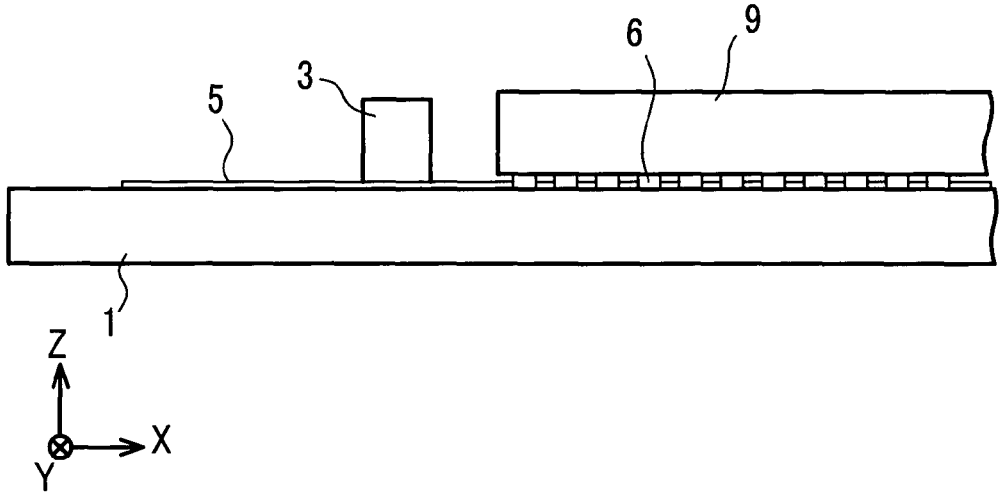
Figure 14:
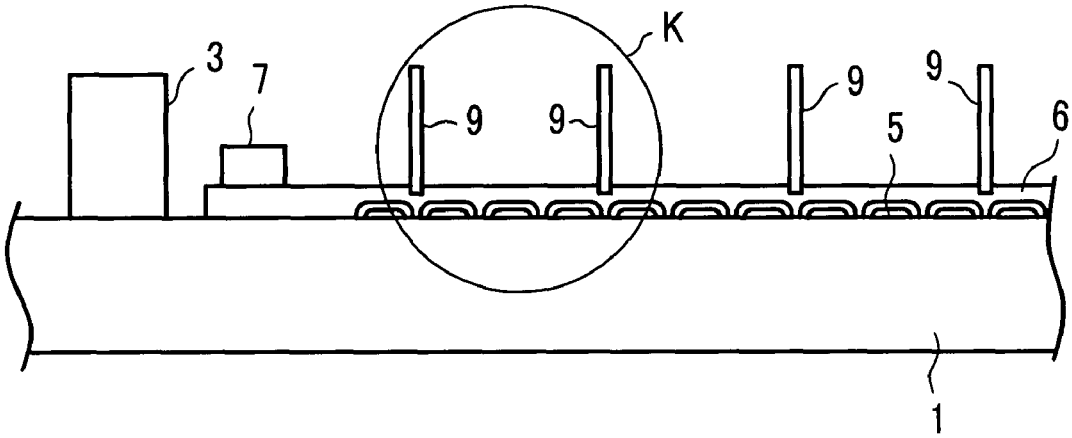
FIG. 14 is a cross-sectional view showing the back substrate and the structure for mounting the distance holding members in an erect manner, as shown in FIG. 13(*a*) and FIG. 13(*b*).
Figure 15:
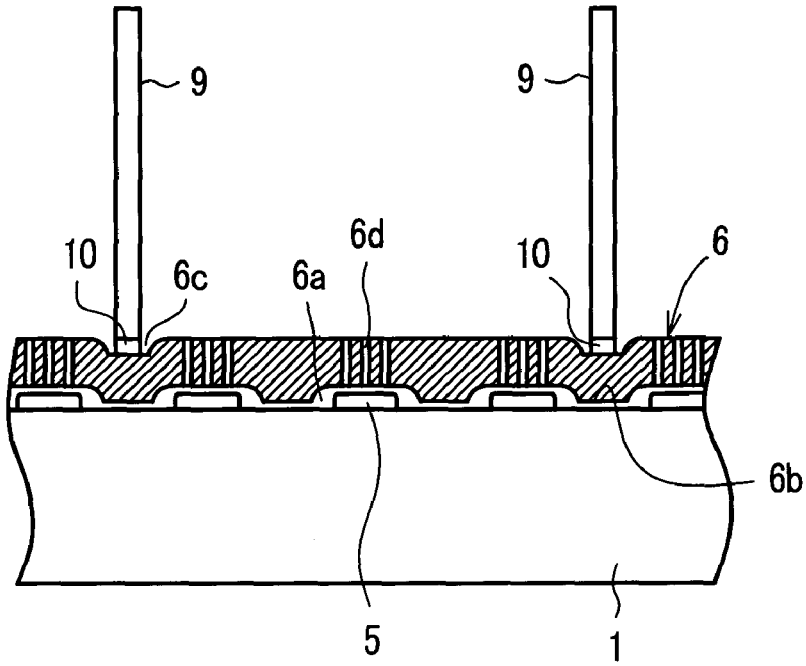
FIG. 15 is an enlarged view of the portion K in FIG. 14.

FIG. 13(*a*) and FIG. 13(*b*) show a third embodiment of the display device according to the present invention. That is, FIG. 13(*a*) and FIG. 13(*b*) schematically show the mounting structure of the distance holding members 9, wherein FIG. 13(*a*) is a plan view of part of a back substrate, shown in a state in which the front substrate is removed, and FIG. 13(*b*) is a cross-sectional view taken along a line I-I' in FIG. 13(*a*). Further, FIG. 14 shows a structure in which distance holding members 9 are mounted on the back substrate 1 in an erect manner, as shown in FIG. 13(*a*) and FIG. 13(*b*). FIG. 15 is an enlarged view of the portion K in FIG. 14.

In the drawings, numeral 6*d* indicates electron passing apertures, and the other numerals which are the same as those in the above-mentioned embodiments indicate identical functional parts. In this embodiment, the distance holding members 9 traverse the plate-member control electrodes 6 and are mounted at positions corresponding to the spaces between cathode lines 5. By mounting the distance holding members 9 such that the distance holding members 9 traverse the plate-member control electrodes 6, an interval between respective strip-like electrode elements which constitute the plate-member control electrodes 6 can be firmly maintained, and, hence, the displacement of the position of the plate-member control electrode 6 and the occurrence of deformation, such as twisting, can be suppressed. In this embodiment, in the same manner as the first embodiment, as the buffering/fixing material 10, a material which is prepared by mixing an adhesive with a highly resilient material made of foamed resin, such as urethane resin, which exhibits a high resiliency during assembling and dissipates in a baking step, is used.

Further, as shown in FIG. 14 and FIG. 15, it is desirable to adopt the following constitution. That is, a portion of the plate-member control electrode 6 which comes into contact with the distance holding member 9 is arranged between neighboring electron passing apertures 6*d* (one or a plural number) formed in the plate-member control electrode 6 for every pixel, and it is arranged at a position where the plate-member control electrode 6 comes into contact with the back substrate 1, directly or by way of an insulation layer, whereby the plate-member control electrode 6 can be firmly pushed.

In the plate-member control electrode 6 used in the display device of this embodiment, a recessed portion 6*a* is formed at a portion where the plate-member control electrode 6 crosses the cathode line 5, so that the plate-member control electrode 6 comes into contact with projections 6*b*, which are formed by the above-mentioned recessed portions 6*a*. Further, a cut-out portion 6*c* is formed in the plate-member control electrode 6 on the opposite side (front substrate side), which corresponds to the location of the projection 6*b*, and one end of the distance holding member 9 is mounted in the cut-out portion 6*d*. It is preferable that, by imparting a taper which opens upwardly to an inner wall of the cut-out portion 6*c*, when pressure is applied to the distance holding member 9 from above, the position of the one end of the distance holding member 9 can be corrected by the taper. Further, the adhesive or the buffering/fixing material 10 which is applied to the front substrate 2 in this embodiment is provided on the black matrix 15 in the x direction in FIG. 10.

Then, the front substrate 2 is laminated to the back substrate 1, and the pressure is applied uniformly from both substrate sides so as to cause the pressure applied to the distance holding members 9 to be uniform. The distance holding members 9 are fixed to the back substrate 1 by frit glass, which is melted and solidified in an ensuing baking step. Here, the urethane resin dissipates in this baking step. In this manner, it is possible to mount the distance holding members 9 such that the stress is uniformly applied between the back substrate 1 and the front substrate 2 with respect to the applied pressure.

Other constitutions and advantageous effects of this embodiment are substantially the same as those of the above-mentioned embodiments. Also, according to this embodiment, a large number of the distance holding members 9 can be mounted with high accuracy in the display device, in which the plate-member control electrodes 6 are arranged between the back substrate 1 and the front substrate 2. Further, the stress attributed to the atmospheric pressure is uniformly applied to a large number of the distance holding members 9; and, hence, rupture of the distance holding members 9, the back substrate 2 or the front substrate 1 can be suppressed, whereby it is possible to obtain a highly reliable display device.

Embodiment 4

In the above-mentioned third embodiment, as the buffering/fixing material 10, a material which is prepared by mixing a adhesive with a highly resilient material made of foamed resin, such as a urethane resin, which possesses high resiliency during assembling and dissipates in the baking process, is used. A fourth embodiment of the present invention is characterized in that, in place of the foamed resin which dissipates in the baking step, a buffering/fixing material, which is prepared by mixing an adhesive with a resilient material made of a heat-resistant aramid-based resin fibers or the like, which do not dissipate by heating at a high temperature for a short time and remains as a reinforcing material, is used.

When the fibers made of heat-resistant aramid-based resin (product name: Kevlar or the like) are used as the resilient material, a sheet made of aramid-based resin fibers is placed between the distance holding members 9 and the back substrate 1 and/or the front substrate 2, and an adhesive, such as frit glass, having a low melting point, is applied to a periphery and an upper portion thereof. Alternatively, a sheet made of aramid-based resin fibers, in which the adhesive is impregnated, is inserted between the distance holding members 9 and the back substrate 1 and/or the front substrate 2. Ensuing pressurizing and heat treatment are performed in the same manner as the previous embodiments. After the heat treatment, the aramid-based resin fibers remain as a reinforcing material.

Also, according to this embodiment, a large number of the distance holding members 9 can be mounted with high accuracy in a display device in which the plate-member control electrodes 6 are arranged between the back substrate land the front substrate 2. Further, the stress attributed to atmospheric pressure is uniformly applied to a large number of the distance holding members 9, and, hence, rupture of the distance holding members 9, the back substrate 2 or the front substrate 1 can be suppressed, whereby it is possible to obtain a highly reliable display device.

Further, in the above-mentioned second and fourth embodiments, in place of applying an adhesive such as frit glass after mounting the heat resistant resin fibers, it is also possible to first apply the adhesive, such as frit glass, and thereafter mount the heat resistant resin fibers. In this case, heating is performed until the adhesive, such as the frit glass, is softened, and, thereafter, pressurizing is performed.

Further, in the above-mentioned respective embodiments, the explanation is mainly directed to cases in which the buffering/fixing material 10 is mounted on the back substrate 1 side and the front substrate 2 side. However, it may be possible to adopt a construction in which the buffering/fixing material 10 is provided to only one of both substrates, and only an adhesive is applied to the other side.

Embodiment 5

Since electrons emitted from the electron source of the cathode line 5 are not focused, when the buffering/fixing layer 10, or the adhesive layer at the front substrate 2 side having the phosphors, is constituted of a completely insulated body, the electrons are charged in the buffering/fixing layer 10 or the adhesive layer, thus giving rise to problems, such as image retention and lowering of contrast. To avoid the occurrence of such charging, a specific resistance of about $10^{11}$ to $10^{12}$ Ω·cm may be imparted to the buffering/fixing layer 10 or the adhesive layer. In this embodiment, a trace amount of conductive particles, such as ATO, is mixed into the buffering/fixing layer 10 or the adhesive layer. Further, a filler which controls the resistance value may be mixed into the conductive material.

As the material which controls the resistance value, it is possible to use a silica coat liquid, which is used for surface treatment of cathode ray tubes or the like. By heating the silica coat at a high temperature, the silica coat is dealcoholized by a sol-gel reaction, thus forming polysiloxane coupling, and the above-mentioned conductive particles are caught in the polysiloxane coupling, whereby the silica coat can attain a stable conductivity. Accordingly, it is possible to realize a countermeasure against charging of the front substrate 2 to which a high voltage is applied. Further, by mixing a material having a light shielding property into the above-mentioned buffering/fixing layer 10 or the adhesive layer, it is possible to form the buffering/fixing layer 10 or the adhesive layer in the black matrix BM applying step.

Here, as a material of the black matrix BM, a material which is softened at 400° C. to 450° C. may be used. Further, to impart a light shielding property to the black matrix EM, an oxide, such as chromium oxide ($Cr_2O_3$), iron oxide ($Fe_2O_3$) or the like, may be added to the black matrix BM. Accordingly, a step of forming the buffering/fixing layer 10 or the adhesive layer can be eliminated, so that the number of manufacturing steps can be reduced and the manufacturing cost also can be reduced.

According to this embodiment, a large number of the distance holding members 9 can be mounted with higher accuracy in the display device in which the plate-member control electrodes 6 are arranged between the back substrate 1 and the front substrate 2. Further, the stress attributed to atmospheric pressure is uniformly applied to a large number of the distance holding members; and, hence, rupture of the distance holding members 9, the back substrate 1 or the front substrate 2 can be suppressed, whereby it is possible to obtain a highly reliable display device.

As has been explained heretofore, according to typical embodiments of the present invention, in a display device in which distance holding members are arranged between the back substrate having the plate-member control electrodes constituted of a large number of the parallel strip-like electrode elements and the front substrate having the phosphors and the anode, the stress applied to the distance holding members can be made substantially uniform, and assembling of the distance holding members can be accurately performed, whereby it is possible to provide a highly reliable display device in which rupture of the distance holding members, the back substrate and the front substrate is obviated.

What is claimed is:

1. A display device comprising:

a front substrate having an anode and phosphors formed on an inner surface thereof;

a back substrate having electron sources provided within a display region on an inner surface thereof, the back substrate being arranged to face the front substrate in an opposed manner with a given distance therebetween;

an outer frame which is interposed between the front substrate and the back substrate such that the outer frame surrounds the display region so as to maintain the given distance, and distance holding members sandwiched between the front substrate and the back substrate in an erect manner within the display region so as to maintain the distance between the front substrate and the back substrate at the given distance;

wherein an inside space which is surrounded by the front substrate, the back substrate and the outer frame is sealed at a given degree of vacuum; and wherein a buffering/fixing material is provided between the distance holding members within the display region and at least one of the front substrate and the back substrate, and the buffering/fixing material is formed by mixing an adhesive with a highly resilient material, which dissipates in a baking step, the buffering/fixing material including conductive particles and material having a light shielding property therein; and wherein the buffering/fixing material has a specific resistance of $10^{11}$ Ω·cm to $10^{12}$ Ω·cm.

2. A display device according to claim 1, wherein the highly resilient material is a low-temperature decomposing foamed resin.

3. A display device according to claim 2, wherein urethane is used as the low-temperature decomposing foamed resin.

4. A display device according to claim 1, wherein a low melting-point glass is used as the adhesive.

5. A display device comprising:

a front substrate having an anode and phosphors formed on an inner surface thereof;

a back substrate having electron sources provided within a display region on an inner surface thereof, the back substrate being arranged to face the front substrate in an opposed manner with a given distance therebetween;

an outer frame which is interposed between the front substrate and the back substrate such that the outer frame surrounds the display region so as to maintain the given distance, and distance holding members sandwiched between the front substrate and the back substrate in an erect manner within the display region so as to maintain the distance between the front substrate and the back substrate at the given distance;

wherein an inside space which is surrounded by the front substrate, the back substrate and the outer frame is sealed at a given degree of vacuum;

wherein buffering/fixing material is provided between the distance holding members within the display region and at least one of the front substrate and the back substrate, and the buffering/fixing material is formed by mixing an adhesive with a highly resilient material, which is present after a baking step, the buffering/fixing material including conductive particles and material having a light shielding property therein; and wherein the buffering/fixing material has a specific resistance of $10^{11}$ Ω·cm to $10^{12}$ Ω·cm.

6. A display device according to claim 5, wherein the highly resilient material is heat-resistant fibers.

7. A display device according to claim 6, wherein the heat-resistant fibers are aramid-based fibers.

8. A display device according to claim 5, wherein the adhesive is a low melting-point glass.

9. A display device according to claim 1, wherein the buffering/fixing material fixes the distance holding members to at least one of the front substrate and the back substrate and to at least one other of the front substrate and the back substrate.

10. A display device according to claim 5, wherein the buffering/fixing material fixes the distance holding members to at least one of the front substrate and the back substrate and to at least one other of the front substrate and the back substrate.

11. A display device according to claim 1, wherein the distance holding members are non-conductive members.

12. A display device according to claim 11, wherein the distance holding members are formed of glass.

13. A display device according to claim 5, wherein the distance holding member are non-conductive members.

14. A display device according to claim 13, wherein the distance holding members are formed of glass.

* * * * *